US012702911B1

(12) United States Patent
Doman et al.

(10) Patent No.: US 12,702,911 B1
(45) Date of Patent: Aug. 11, 2026

(54) PORTABLE SPORTS NET

(71) Applicant: Leap Products, LLC, Lindon, UT (US)

(72) Inventors: Bryce Doman, Alpine, UT (US); Emmanuel Karlsson, Orem, UT (US)

(73) Assignee: Leap Products, LLC, Lindon, UT (US)

( * ) Notice: Subject to any disclaimer, the term of this patent is extended or adjusted under 35 U.S.C. 154(b) by 0 days.

(21) Appl. No.: 18/633,336

(22) Filed: Apr. 11, 2024

Related U.S. Application Data

(63) Continuation of application No. 17/579,413, filed on Jan. 19, 2022, now abandoned.

(60) Provisional application No. 63/139,075, filed on Jan. 19, 2021.

(51) Int. Cl.
*A63B 71/02* (2006.01)

(52) U.S. Cl.
CPC ..... *A63B 71/023* (2013.01); *A63B 2210/50* (2013.01)

(58) Field of Classification Search
CPC . A63B 2210/50; A63B 71/023; A63B 61/003; A63B 69/38; A63B 2102/02; A63B 61/00
See application file for complete search history.

(56) References Cited

U.S. PATENT DOCUMENTS 2,666,640 A * 1/1954 Jennings, Sr. ..... A63B 3/00 482/141
3,640,557 A * 2/1972 Nute, Jr. ..... E04B 9/064 403/287
4,010,951 A * 3/1977 Gronlund ..... A63B 61/02 473/492
4,357,019 A * 11/1982 Wouters ..... A63B 67/002 473/473
5,029,853 A * 7/1991 Cunningham ..... A63B 61/003 473/459
5,118,103 A * 6/1992 Miller ..... A63B 71/022 473/197
5,690,339 A * 11/1997 Chen ..... A63B 63/004 273/400
5,816,956 A * 10/1998 Ellis ..... A63B 61/00 473/492

(Continued)

FOREIGN PATENT DOCUMENTS

CN 203389300 U * 1/2014
CN 204601542 U * 9/2015

(Continued)

OTHER PUBLICATIONS

CN 203389300 U (Year: 2014).*

(Continued)

*Primary Examiner* — John E Simms, Jr.
*Assistant Examiner* — Amir A Klayman
(74) *Attorney, Agent, or Firm* — Thorpe North & Western, LLP.; David W. Osborne

(57) ABSTRACT

Devices and associated methods for a portable frame for a sports net are described. In one embodiment, the portable frame for the sports net can comprise a frame including first and second base members with first and second horizontally-oriented openings operable to receive a cross member connecting the first and second base members. The portable frame for the sports net can further comprise first and second vertical openings operable to receive first and second vertical posts held at an angle other than 90° relative to a horizontal plane of the cross member.

14 Claims, 10 Drawing Sheets

(56) References Cited

U.S. PATENT DOCUMENTS

| | | | | | |
|---|---|---|---|---|---|
| 5,878,802 | A * | 3/1999 | Richter | F16B 7/04 | 403/231 |
| 6,370,803 | B1 * | 4/2002 | Burquest | G09F 17/00 | 40/607.1 |
| 7,866,074 | B2 * | 1/2011 | McComb | B43L 1/045 | 40/606.01 |
| 9,750,996 | B2 * | 9/2017 | Nelson | A63B 63/00 | |
| 9,795,849 | B2 * | 10/2017 | Nelson | A63B 69/00 | |
| 10,010,775 | B2 * | 7/2018 | Dinoffer | A63B 61/04 | |
| 10,183,206 | B2 * | 1/2019 | Nelson | A63B 63/00 | |
| 10,543,413 | B2 * | 1/2020 | Nelson | A63B 71/022 | |
| 2019/0118054 | A1 * | 4/2019 | Crosby | A63B 63/004 | |

FOREIGN PATENT DOCUMENTS

| | | | | | |
|---|---|---|---|---|---|
| CN | 206167812 | U | * | 5/2017 | |
| CN | 211705824 | U | * | 10/2017 | |
| CN | 114191794 | A | * | 3/2022 | A63B 61/02 |
| FR | 2809322 | A1 | * | 11/2001 | A63B 61/003 |
| FR | 3031042 | A1 | * | 7/2016 | A63B 61/02 |
| FR | 3031043 | A1 | * | 7/2016 | A63B 61/003 |
| GB | 2549457 | A | * | 10/2017 | A63B 61/04 |
| JP | 2011024660 | A | * | 2/2011 | |

OTHER PUBLICATIONS

FR 2809322 A1 (Year: 2001).*
FR 3031042 A1 (Year: 2016).*
CN 114191794 A (Year: 2022).*
CN 204601542 U (Year: 2015).*
CN 206167812 U (Year: 2017).*
CN 211705824 U (Year: 2020).*
FR 3031043 A1 (Year: 2016).*
JP 2011024660 A (Year: 2011).*

* cited by examiner

PORTABLE SPORTS NET

PRIORITY DATA

This is a continuation application of U.S. application Ser. No. 17/579,413, filed Jan. 19, 2022, entitled "Portable Sports Net" which claims the benefit of U.S. Provisional Application Ser. No. 63/139,075, filed Jan. 19, 2021, and entitled, "Portable Sports Net", each of which is incorporated by reference in its entirety herein.

FIELD OF THE DISCLOSURE

The present disclosure relates generally to portable sports net assemblies and methods. Accordingly, the present disclosure involves the mechanical arts field.

BACKGROUND

Pickleball is a paddleball sport with many similarities to badminton, table tennis, tennis, racquetball, and the like. Two players or four players can use solid paddles to hit a perforated ball over a net back and forth. Pickleball is one of the fastest spreading backyard sports, with participants ranging from young kids to elderly adults.

However, storing and setting up a pickleball net presents several obstacles: first, many nets are difficult to store because of the sheer size involved; second, moving the net to a location can be difficult without numerous people to help out; third, setting up the net can be time-consuming; fourth, assembling the net can be confusing for people who are not mechanically-inclined; fifth, correct assembly can be difficult without proper instructions; dissembling the net presents many of the same challenges; and moving the assembled net around short distances can be impractical without the assistance of non-participants. Overall, a casual pickleball game can be tough to play unless a pickleball court is already set up.

A pickleball court has dimensions that are similar to tennis and the other racquet sports. The actual size of the court is 20 feet by 44 feet. The serving line is about 15 feet from the baseline and the non-volley zone is about 7 feet between the serving line and the net. The center line divides the left service court from the right service court. As such, many of the issues that face pickleball participants can also affect participants in other racquet-based sports.

SUMMARY

In one disclosure embodiment, a portable frame for a sports net can include a frame including first and second base members with first and second horizontally-oriented openings operable to receive a cross member connecting the first and second base members. In one aspect, the portable frame for the sports net can further include first and second vertical openings operable to receive first and second vertical posts held at an angle other than 90° relative to a horizontal plane of the cross member.

In another disclosure embodiment, a portable frame for a sports net can include first and second base members with first and second horizontally-oriented openings operable to receive a cross member connecting the first and second base member, and first and second vertical openings operable to receive first and second vertical posts. In one aspect, the cross member can include first and second outer tenons tongues shaped and sized to fit into the first and second horizontally-oriented openings, wherein the first and second outer tenon tongues include first and second outer tenon tongue sockets. In another aspect, the first and second vertical posts can be shaped and sized to fit into the first and second vertically-oriented openings and the first and second outer tenon tongue sockets. In yet another aspect, the first and second base members and the cross member can be configured in the same vertical plane.

In yet another disclosure embodiment, a portable sports net assembly can include a frame including first and second base members with first and second horizontally-oriented openings and first and second vertical openings operable to receive first and second vertical posts held at an angle other than 90° relative to a horizontal plane of the cross member. In one aspect, the cross member can include first and second outer tenons tongue shaped and sized to fit into the first and second horizontally-oriented openings. In another aspect, first and second vertical posts can be shaped and sized to fit into the first and second vertical openings at an angle other than 90° relative to a horizontal plane of the cross member. In yet another aspect, a portable sports net assembly can include a net strung between the first and second vertical posts above the cross member, wherein the angle other than 90° retains a top edge of the net in a taut orientation using a spring effect.

In yet another disclosure embodiment, a method of tensioning a sports net can include providing a frame for the sports net including first and second base members, and a cross member connecting the first second and base members. In one aspect, the method can include holding first and second vertical posts to the frame at an angle other than 90° relative to a horizontal plane of the cross member. In yet another aspect, the method can include retaining the sports net between the first and second vertical posts.

There has thus been outlined, rather broadly, the more important features of the disclosure so that the detailed description thereof that follows may be better understood, and so that the present contribution to the art may be better appreciated. Other features of the present disclosure will become clearer from the following detailed description of the disclosure, taken with the accompanying drawings and claims, or may be learned by the practice of the disclosure.

BRIEF DESCRIPTION OF THE DRAWINGS

Features and advantages of technology embodiments will be apparent from the detailed description which follows, taken in conjunction with the accompanying drawings, which together illustrate, by way of example, various technology features; and, wherein.

Figure 1:
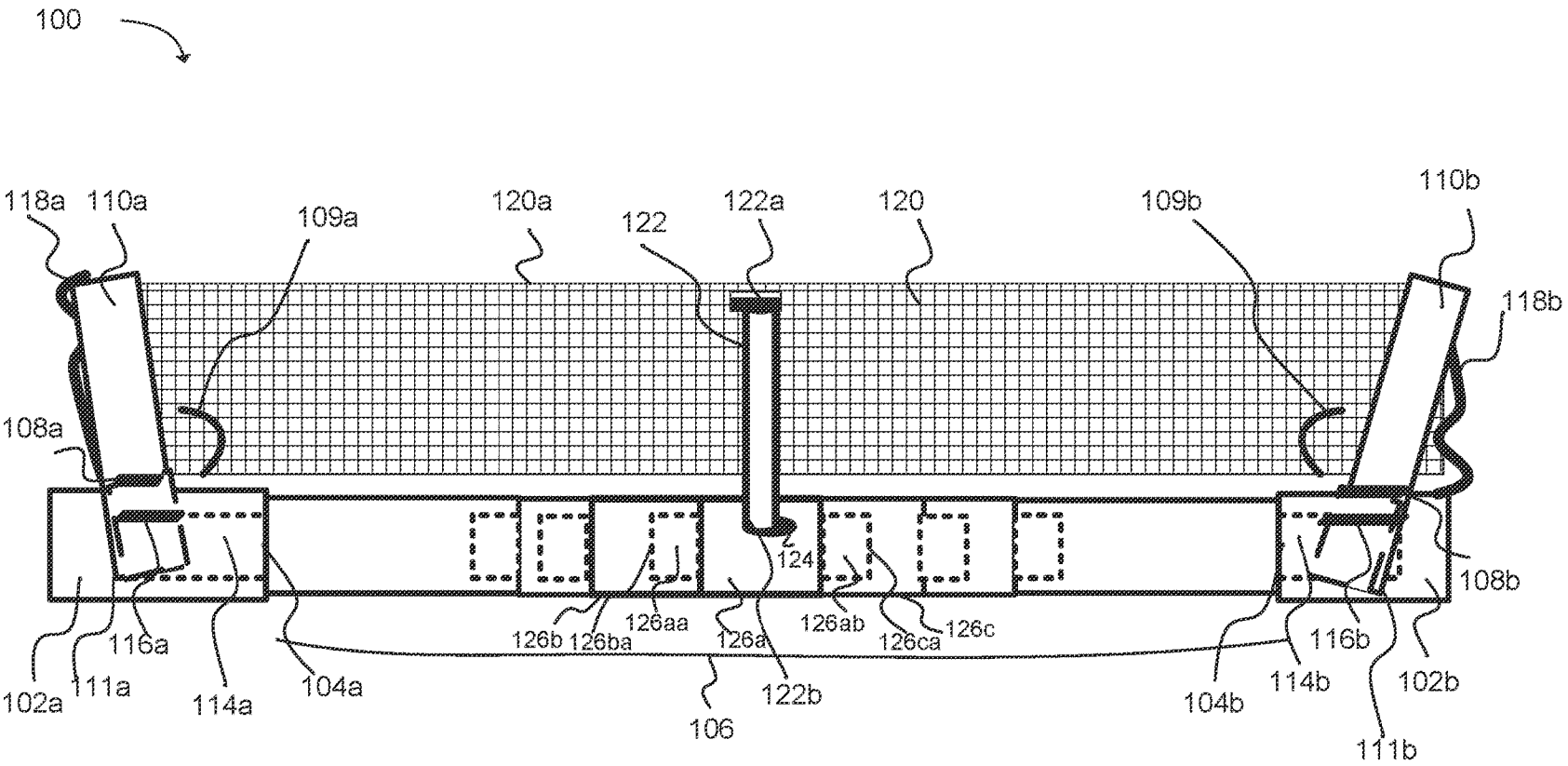
FIG. 1 shows a cross-sectional view of a portable sports net assembly in accordance with an example embodiment.

These drawings are provided to illustrate various aspects of the disclosure and are not intended to be limiting of the scope in terms of dimensions, materials, configurations, arrangements or proportions unless otherwise limited by the claims.

DETAILED DESCRIPTION

While these exemplary embodiments are described in sufficient detail to enable those skilled in the art to practice the disclosure, it should be understood that other embodiments may be realized and that various changes to the disclosure may be made without departing from the spirit and scope of the present disclosure. Thus, the following more detailed description of the embodiments of the present disclosure is not intended to limit the scope of the disclosure, as claimed, but is presented for purposes of illustration and not limitation to describe the features and characteristics of the present disclosure, to set forth the best mode of operation of the disclosure, and to sufficiently enable one skilled in the art to practice the disclosure. Accordingly, the scope of the present disclosure is to be defined solely by the appended claims.

Definitions

In describing and claiming the present disclosure, the following terminology will be used in accordance with the definitions set forth below.

The singular forms "a," "an," and, "the" in the written description include express support for plural referents unless the context clearly dictates otherwise.

In this disclosure, "comprises," "comprising," "containing" and "having" and the like can have the meaning ascribed to them in U.S. Patent law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. Patent law. "Consisting essentially of" or "consists essentially of" have the meaning generally ascribed to them by U.S. Patent law. In particular, such terms are generally closed terms, with the exception of allowing inclusion of additional items, materials, components, steps, or elements, that do not materially affect the basic and novel characteristics or function of the item(s) used in connection therewith. For example, trace elements present in a composition, but not affecting the composition's nature or characteristics would be permissible if present under the "consisting essentially of" language, even though not expressly recited in a list of items following such terminology. When using an open-ended term, like "comprising" or "including," in the written description it is understood that direct support should also be afforded to "consisting essentially of" language as well as "consisting of" language as if stated explicitly and vice versa.

The terms "first," "second," "third," "fourth," and the like in the written description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the order in which such steps may be performed, and certain of the stated steps may possibly be omitted and/or certain other steps not described herein may possibly be added to the method.

The terms "left," "right," "front," "back," "top," "bottom," "over," "under," and the like in the written description and in the claims, if any, are used for descriptive purposes and not necessarily for describing permanent relative positions. It is to be understood that the terms so used are interchangeable under appropriate circumstances such that the embodiments described herein are, for example, capable of operation in other orientations than those illustrated or otherwise described herein. The term "coupled," as used herein, is defined as directly or indirectly connected in a mechanical or nonmechanical manner. Objects or structures described herein as being "adjacent to" each other may be in physical contact with each other, in close proximity to each other, or in the same general region or area as each other, as appropriate for the context in which the phrase is used. Occurrences of the phrase "in one embodiment," or "in one aspect," herein do not necessarily all refer to the same embodiment or aspect.

Reference throughout this specification to "an example" means that a particular feature, structure, or characteristic described in connection with the example is included in at least one embodiment of the present disclosure. Thus, appearances of the phrases "in an example" or "an embodiment" or in "an aspect" in various places throughout this specification are not necessarily all referring to the same embodiment.

Reference in the written description may be made to devices, structures, systems, or methods that provide "improved" performance. It is to be understood that unless otherwise stated, such "improvement" is a measure of a benefit obtained based on a comparison to devices, structures, systems or methods in the prior art. Furthermore, it is to be understood that the degree of improved performance may vary between disclosed embodiments and that no equality or consistency in the amount, degree, or realization of improved performance is to be assumed as universally applicable.

As used herein, the term "about" is used to provide flexibility to a numerical range endpoint by providing that a given value may be "a little above" or "a little below" the endpoint. However, it is to be understood that even when the term "about" is used in the present specification in connection with a specific numerical value, that support for the exact numerical value recited apart from the "about" terminology is also provided.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof. As used in this written description, express support for items or actions used with the term "substantially" is also afforded to the item or action without the term "substantially." For example, the terms "substantially closed" also provides express support for the term "closed."

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

As used herein, comparative terms such as "increased," "decreased," "better," "worse," "higher," "lower," "enhanced," and the like refer to a property of a device, component, or activity that is measurably different from other devices, components, or activities in a surrounding or adjacent area, in a single device or in multiple comparable devices, in a group or class, in multiple groups or classes, or as compared to the known state of the art. For example, composition or system that has or provides "increased" stability exhibits a higher degree of stability as compared to a different, yet comparable composition or system, or as compared to a composition or system known in the art. A number of factors can cause such increased stability, including composition ingredients, system components or structures, operation, etc.

The terms "coupled," or "connected" or like words as used herein, are defined as directly or indirectly connected in a mechanical or nonmechanical manner. Objects. "Directly coupled" objects or structures are in physical contact and are attached. Objects described herein as being "adjacent to" each other may be in physical contact with each other, in close proximity to each other, or in the same general region or area as each other, as appropriate for the context in which the phrase is used. In this written description, recitation of "coupled" or "connected" or variations of their respective root words, such as "coupling" or "connection" or "connecting," provides express support for "directly coupled" or "directly connected" and variations of their respective root words and vice versa.

Numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually. This same principle applies to ranges reciting only one numerical value as a minimum or a maximum. Furthermore, such an interpretation should apply regardless of the breadth of the range or the characteristics being described.

DESCRIPTION OF EMBODIMENTS

An initial overview of technology embodiments is provided below and specific technology embodiments are then described in further detail. This initial summary is intended to aid readers in understanding the technology more quickly but is not intended to identify key or essential features of the technology, nor is it intended to limit the scope of the claimed subject matter. Unless defined otherwise, all technical and scientific terms used herein have the same meaning as commonly understood by one of ordinary skill in the art to which this disclosure belongs.

Backyard tennis courts, pickleball courts, badminton courts, and the like can be very expensive to install and maintain. For example, a backyard tennis court can cost anywhere from $20,000 to $100,000 to initially install. Even a simpler court-based game, such as badminton, can cost between $5,000 and $10,000 on the low-end, and an indoor ping pong table can cost between $500 and $1,000. Therefore, a portable sports net that can recreate the experience of a racquet-based game without the high-cost would be desirable.

Pickleball is another racquet-based sport that faces many of these obstacles. The dimensions of a pickleball court are similar to tennis courts. For example, the dimensions of the court are 20 feet by 44 feet, with a serving line that is about 15 feet from the baseline and a non-volley zone that is about 7 feet between the serving line and the net. The center line evenly divides the left service court from the right service court.

Storing a pickleball net assembly can be difficult because of number and volume of components involved. For example, a net can be about 21 feet 9 inches long from one vertical post to the other with a height of about 36 inches from top to bottom. Each vertical post holding up the net can be more than 36 inches in height to accommodate the net. The cross members between the net can be about 22 feet long. Each base member joining the cross members and the vertical posts can also take up a large amount of space. Consequently, the bulk and weight of the pickleball net can be difficult to deal with for a non-professional pickleball player.

In some cases, 4 pickleball players may wish to play at once, but most of the time, two pickleball players may want to play a pickleball game. When two players wish to play, then it can difficult for them to move the assembly to a playing location from a storage location. For example, a heavy bulky sports net may use between 5 and 10 people to assemble without too much difficulty or time, especially when the players are young kids or elderly adults. In many cases, young kids and elderly adults may not want to invest the time to remove a sports assembly from storage, assemble the sports assembly, play the game, dissemble the sports assembly, then move the sports assembly back into storage because the time available to actually play the game may be far less than the time used to set up the game. Overall, a casual pickleball game can be tough to play unless a pickleball court is already set up.

In addition to these issues, a portable net assembly that is convenient to remove from storage, assemble, disassemble, and put back into storage can suffer from several drawbacks. For example, after wear and tear, the net can start to droop towards the center due to loss of elasticity in the net tensioning (e.g., the straps, the net top, and the like). Some net assemblies may decrease the challenges involved in storage and assembly by decreasing the durability of the components. For example, a cheap design may need continual replacement. Also, the actual gameplay can be subpar compared to courts that have been professionally installed when the net assembly does not conform to tennis, pickleball, badminton, or other standards.

As a result, devices, assemblies, and methods for a portable sports net that is quickly and easily assembled, has high durability, facilitates easy storage, and prevents defects associated with wear and tear are disclosed herein.

In one disclosure embodiment, a portable frame for a sports net can include a frame including first and second base members with first and second horizontally-oriented openings operable to receive a cross member connecting the first and second base members, and first and second vertical openings operable to receive first and second vertical posts held at an angle other than 90° relative to a horizontal plane of the cross member.

In another disclosure embodiment, a portable frame for a sports net can include first and second base members with first and second horizontally-oriented openings operable to receive a cross member connecting the first and second base member, and first and second vertical openings operable to receive first and second vertical posts. The portable frame can include cross member including first and second outer tenons tongues shaped and sized to fit into the first and second horizontally-oriented openings, wherein the first and second outer tenon tongues include first and second outer tenon tongue sockets. The portable frame can include the first and second vertical posts are shaped and sized to fit into the first and second vertically-oriented openings and the first and second outer tenon tongue sockets. The first and second base members and the cross member can be configured in the same vertical plane In yet another disclosure embodiment, a portable sports net assembly can include a frame including first and second base members with first and second horizontally-oriented openings and first and second vertical openings operable to receive first and second vertical posts held at an angle other than 90° relative to a horizontal plane of the cross member. The portable sports net assembly can include a cross member comprising first and second outer tenons tongue shaped and sized to fit into the first and second horizontally-oriented openings. The portable sports net assembly can include first and second vertical posts shaped and sized to fit into the first and second vertical openings at an angle other than 90° relative to a horizontal plane of the cross member. The portable sports net assembly can include a net strung between the first and second vertical posts above the cross member, wherein the angle other than 90° retains a top edge of the net in a taut orientation using a spring effect.

In yet another disclosure embodiment, a method of tensioning a sports net, can include providing a frame for the sports net including first and second base members, and a cross member connecting the first second and base members, holding first and second vertical posts to the frame at an angle other than 90° relative to a horizontal plane of the cross member, and retaining the sports net between the first and second vertical posts.

In one embodiment, as illustrated in FIG. 1, a portable frame for a sports net 100 can include a frame including first and second base members 102*a* and 102*b* with first and second horizontally-oriented openings 104*a* and 104*b* operable to receive a cross member 106 connecting the first and second base members 102*a* and 102*b*, and first and second vertical openings 108*a* and 108*b* operable to receive first and second vertical posts 110*a* and 110*b* held at an angle other than 90° 109*a* and 109*b* relative to a horizontal plane of the cross member 106.

In one example, the first and second vertical posts 110*a* and 110*b* can be held at the angle other than 90° by the first and second vertical openings 108*a* and 108*b*. In this example, the first and second vertical openings 108*a* and 108*b* can hold the first and second vertical posts 110*a* and 110*b* without being held by openings in the cross member 106. In this example, the first and second vertical openings 108*a* and 108*b* can provide sufficient stability to hold the first and second vertical posts 110*a* and 110*b* without substantial movement of the first and second vertical posts 110*a* and 110*b* after assembly.

In one aspect, the first and second vertical posts 110*a* and 110*b* can be held at the angle other than 90° by a tight tolerance between the first and second vertical openings 108*a* and 108*b* when holding the first and second vertical posts 110*a* and 110*b*. In another aspect, coupling a net between the first and second vertical posts 110*a* and 110*b* can enhance the stability of the portable frame for the sports net 100. In some examples, the first and second vertical posts 110*a* and 110*b* can be held at the angle other than 90° without using fasteners, spring detents, clamping forces, bungee cords, the like, or a combination thereof.

In another aspect, the first and second vertical posts 110*a* and 110*b* can be held at the angle other than 90° using threaded first and second vertical posts 110*a* and 110*b* that can be held by threaded first and second vertical openings 108*a* and 108*b*. In another example, the first and second vertical posts 110*a* and 110*b* can be held at the angle other than 90° using one or more mating brackets. In one example, the mating bracket receiver can be coupled to the first and second vertical openings 108*a* and 108*b*, and the matching bracket insert can be coupled to the first and second vertical posts 110*a* and 110*b*. In another example, the mating bracket receiver can be coupled to the first and second vertical posts 110*a* and 110*b*, and the matching bracket insert can be coupled to the first and second vertical openings 108*a* and 108*b*.

In another aspect, the first and second vertical posts 110*a* and 110*b* can be held at the angle other than 90° using a sleeve opening or a sleeve post that can be welded at the desired angle other than 90° to the first and second base members 102*a* and 102*b*. In one example, the sleeve opening can be shaped and sized to fit around the first and second vertical posts 110*a* and 110*b*. In another example, the sleeve post can be shaped and sized to fit into an inside circumference of the first and second vertical posts 110*a* and 110*b*.

In one aspect, the sleeve opening or sleeve post can be coupled to the first and second base members 102*a* and 102*b* using a fastener disclosed herein. In another aspect, the sleeve opening or sleeve post can comprise one or more of wood, aluminum, steel, alloys thereof, plastics, such as vinyl, acrylic, compound thereof, the like, or a combination thereof.

In another aspect, the thickness of the first and second vertical posts can be selected to minimize a deviation from a desired angle other than 90°. For example, a small thickness can result in the vertical posts being changed from the desired angle when by the force between the vertical posts when the portable frame for a sports net 100 has been used. In one aspect, the selected thickness can prevent the first and second vertical posts 110*a* and 110*b* from bending to a 90° angle or to an undesired angle. In one aspect, the first and second vertical posts 110*a* and 110*b* can comprise a thickness of from about 1 mm to about 10 mm. In another aspect, the first and second vertical posts 110*a* and 110*b* can comprise a thickness of from about 1.5 mm to about 4.5 mm. In yet another aspect, the first and second vertical posts 110*a* and 110*b* can comprise a thickness of from about 2 mm to about 4 mm. In another aspect, the first and second vertical posts 110*a* and 110*b* can comprise a thickness of about 3 mm.

In one aspect, the first and second vertical openings 108*a* and 108*b* are shaped and sized to receive and hold the first and second vertical posts 110*a* and 110*b* at the angle other than 90°. In one example, the shape and size of the first and second vertical openings 108*a* and 108*b* can be shaped and sized to receive and hold the first and second vertical posts 110*a* and 110*b* at the angle other than 90° when the shape and size of the first and second vertical openings 108*a* and 108*b* complements the shape and size of the vertical posts 110*a* and 110*b*.

In one example, when the shape of the first and second vertical openings 108*a* and 108*b* is substantially circular, and the shape and size of the vertical posts 110*a* and 110*b* is cylindrical, then the shape of the first and second vertical openings 108*a* and 108*b* can complement the shape and size of the vertical posts 110*a* and 110*b*. In another example, when the shape of the first and second vertical openings 108*a* and 108*b* is substantially rectangular, and the shape and size of the vertical posts 110*a* and 110*b* is a rectangular cuboid, then the shape of the first and second vertical openings 108*a* and 108*b* can complement the shape and size of the vertical posts 110*a* and 110*b*.

In another example, the size of the first and second vertical openings 108*a* and 108*b* can complement the size of the vertical posts 110*a* and 110*b* when the vertical posts 110*a* and 110*b* can fit into the first and second vertical openings 108*a* and 108*b* without substantial gaps between the vertical posts 110*a* and 110*b* and the first and second vertical openings 108*a* and 108*b*.

In one aspect, the cross member 106 can include first and second cross member openings 116*a* and 116*b* shaped and sized to receive and hold the first and second vertical posts 110*a* and 110*b* at the angle other than 90°. In this example, the first and second cross member openings 116*a* and 116*b* can hold the first and second vertical posts 110*a* and 110*b* without being held by openings in the first and second base members 102*a* and 102*b*. In this example, the first and second cross member openings 116*a* and 116*b* can provide sufficient stability to hold the first and second vertical posts 110*a* and 110*b* without substantial movement of the first and second vertical posts 110*a* and 110*b* after assembly.

The first and second cross member openings 116*a* and 116*b* can be configured to hold the first and second vertical posts 110*a* and 110*b* at the angle other than 90° in various ways. In one example, the first and second cross member openings 116*a* and 116*b* can be spatially separated from the first and second outer tenon tongues 114*a* and 114*b*. In this example, the first and second vertical posts 110*a* and 110*b* can be held at the angle other than 90° by the cross member 106 without being held at the angle other than 90° by the first and second base members 102*a* and 102*b*.

The first and second cross member openings 116*a* and 116*b* can be spatially integrated with the first and second outer tenon tongues 114*a* and 114*b*. In one example, the first and second cross member openings 116*a* and 116*b* can include first and second outer tenon tongue sockets 116*a* and 116*b* in first and second outer tenon tongues 114*a* and 114*b* that are shaped and sized to receive and hold the first and second vertical posts 110*a* and 110*b* at the angle other than 90°.

When the first and second cross member openings 116*a* and 116*b* are spatially integrated with the first and second outer tenon tongues 114*a* and 114*b*, the first and second cross member openings 116*a* and 116*b* can be shaped and sized to fit into the first and second horizontally-oriented openings 104*a* and 104*b*. In this example, the first and second vertical posts 110*a* and 110*b* can be shaped and sized to fit into the first and second vertically-oriented openings 108*a* and 108*b*, and the first and second vertical posts 110*a* and 110*b* can be shaped and sized to fit into the first and second outer tenon tongue sockets 116*a* and 116*b* at the angle other than 90°.

In one example, the first and second vertical posts 110*a* and 110*b* can be shaped and sized to fit into the first and second vertically-oriented openings 108*a* and 108*b* and can be held by the first and second vertically-oriented openings 108*a* and 108*b* at the angle other than 90° without the prevention of substantial angular movement by the first and second outer tenon tongue sockets 116*a* and 116*b* at the angle other than 90°. In this example, the stability provided to the vertical posts 110*a* and 110*b* that substantially prevents angular movement away from the angle other than 90° can be provided by the by the first and second vertically-oriented openings 108*a* and 108*b* even though the first and second outer tenon tongue sockets 116*a* and 116*b* may not prevent substantial movement away from the angle other than 90° without the first and second vertically-oriented openings 108*a* and 108*b*.

In one example, the first and second vertical posts 110*a* and 110*b* can be shaped and sized to fit into the first and second outer tenon tongue sockets 116*a* and 116*b* and can be held by the first and second outer tenon tongue sockets 116*a* and 116*b* at the angle other than 90° without the prevention of substantial angular movement by the first and second vertically-oriented openings 108*a* and 108*b* at the angle other than 90°. In this example, the stability provided to the vertical posts 110*a* and 110*b* that substantially prevents angular movement away from the angle other than 90° can be provided by the by the first and second outer tenon tongue sockets 116*a* and 116*b* even though the first and second vertically-oriented openings 108*a* and 108*b* may not prevent substantial movement away from the angle other than 90° without the first and second outer tenon tongue sockets 116*a* and 116*b*.

The first and second outer tenon tongues 114*a* and 114*b* can comprise various materials including one or more of: solid plastic, solid metal (e.g. aluminum), a hollow molded article such as molded plastic or metal, the like, or a combination thereof. The base members 102*a* and 102*b*, the cross member 106, the vertical posts 210*a* and 210*b*, or a combination thereof can comprise one or more of: wood, aluminum, steel, alloys thereof, plastics, such as vinyl, acrylic, compound thereof, the like, or a combination thereof.

In another aspect, the first and second vertical posts 110*a* and 110*b* can be operable to secure the cross member 106 to the first and second base members 102*a* and 102*b* when a bottom end of the first and second vertical posts 111*a* and

111*b* are joined to the first and second vertical openings 108*a* and 108*b* inside of the first and second base members 102*a* and 102*b*.

In one aspect, the first and second vertical openings 108*a* and 108*b* can be operable to receive the first and second vertical posts 110*a* and 110*b* held at an angle other than 90 degrees relative to the horizontal plane of the cross member 106 when the first and second vertical posts 110*a* and 110*b* and the cross member 106 are in the same vertical plane.

The first and second vertical posts 110*a* and 110*b* can be shaped and sized to fit into the first and second vertically openings 108*a* and 108*b*. The first and second vertical posts 110*a* and 110*b* can be shaped and sized to fit into the first and second vertically openings 108*a* and 108*b* without being held to an angle other than 90° by the first and second vertically openings 108*a* and 108*b*. In one example, first and second vertical posts 110*a* and 110*b* can be held to an angle other than 90° by the first and second outer tenon tongue sockets 116*a* and 116*b*.

In some examples, the first and second vertical posts 110*a* and 110*b* can be held to an angle other than 90° to prevent slackness of a sports net between the first vertical post 110*a* and the second vertical post 110*b*. For example, when a sports net is held between two vertical posts, then the sports net can slack near the center because of a lack of adequate tension in the top edge of the sports net. On the other hand, holding a first vertical post 110*a* at an angle greater than 90° between the first vertical post 110*a* and the horizontal plane of the cross member 106 and holding a second vertical post 110*b* at an angle greater than 90° between the second vertical post 110*b* and the horizontal plane of the cross member 106 can increase the tension of the sports net relative to the tension of the sports net when the first and second vertical posts 110*a* and 110*b* are held at a 90° or less with the cross member 106.

In one example, the angle other than 90° can be a 91° angle. In this example, the difference in angle between the first vertical post 110*a* and the horizontal plane of the cross member 106 can increase the distance between a center of the sports net and the end of the vertical post holding the top edge of the sports net by more than about 0.55 inches and less than about 0.75 inches. Similarly, the difference in angle between the second vertical post 110*b* and the horizontal plane of the cross member 106 can increase the distance between a center of the sports net and the end of the vertical post 110*b* holding the top edge of the sports net by more than about 0.55 inches and less than about 0.75 inches.

Consequently, the total displacement caused by the increased tension in the sports net can be from about 1.10 inches to about 1.40 inches when the angle other than 90° is a 91° angle. When the angle other than 90° is a 91° angle, the tension of the sports net can change by greater than one or more of 1%, 2%, 3%, 4%, 5%, 10%, 20%, the like, or a combination thereof compared to the tension of the sports net when the angle between the cross member 106 and the first and second vertical posts 110*a* and 110*b* is 90°.

In one example, the angle other than 90° can be configured to retain a top edge of a sports net in a taut orientation relative to a slack orientation of the top edge of the sports net when an angle relative to the horizontal plane of the cross member is 90°. In one aspect, the angle other than 90° can be configured to retain the top edge of the sports net in a taut orientation using an extension spring effect.

In one aspect, the cross member 106 can include segmented cross members including a middle segment 126*a* having a first end 126*aa* with a first horizontally-oriented tenon tongue and a second end 126*ab* with a second horizontally-oriented tenon tongue. In one aspect, the cross member can further comprise a first inner segment 126*b* having a first inner mortice 126*ba* shaped and sized to join the first end 126*aa* of the middle segment 126*a*, and a second inner segment 126*c* having a second inner mortice 126*ca* shaped and sized to join the second end 126*ab* of the middle segment 126*a*.

The portable frame for the sports net 100 can include various other components for preventing a slack orientation of the sports net. In one aspect, the first and second vertical posts 110*a* and 110*b* can each include straps 118*a* and 118*b* operable to secure a top edge 120*a* of a sports net 120 in a taut orientation. In another aspect, the portable frame for the sports net can include a flexible support 122 having a fiberglass material with a bottom end 122*b* fitting a recess 124 in the cross member 106 and a top elongated split end 122*a* fitting an underside of a sports net top 120*a*. In another aspect, the first and second vertical posts 110*a* and 110*b* can be configured to retain a sports net 120 above the cross member 106.

Figure 2A:
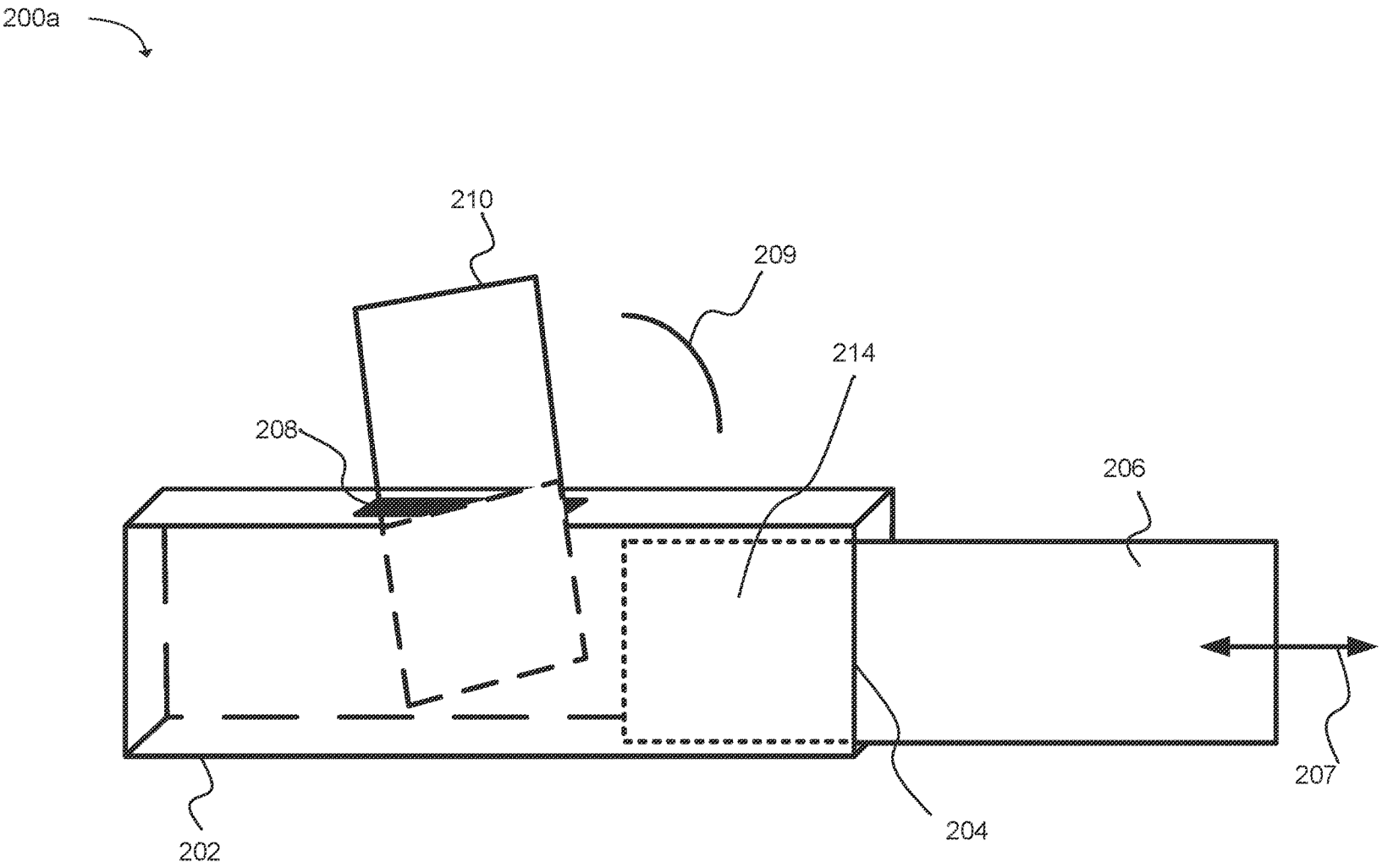
FIG. 2*a* shows a cross-sectional view of a portable frame for a sports net holding a vertical post at an angle other than 90° in accordance with an example embodiment.

With this initial overview in mind, the devices and methods of the current disclosure will be described in more detail. In one embodiment, as illustrated in FIG. 2*a*, a portable frame for a sports net 200*a* can comprise the base member 202 in which the the horizontally-oriented opening 204 can be operable to receive a cross member 206. The cross member 206 can be configured to connect the base member 202 to a second base member.

The base member 202 can comprise a vertical opening 208 that can be operable to receive a vertical post 210. The vertical post 210 can be held at an angle 209 other than 90° relative to a horizontal plane 207 of the cross member 206. The vertical post can be held at the angle 209 other than 90° in various ways including: (a) the vertical opening 208 shaped and sized to receive and hold the vertical post 210 at the angle 209, (b) a cross member opening shaped and sized to receive and hold the vertical post at the angle 209, or (c) both the vertical opening 208 and the cross member opening shaped and sized to receive and hold the vertical post 210 at the angle 209.

When the vertical opening 208 is shaped and sized to receive and hold the vertical post 210 at the angle 209, as illustrated in FIG. 2*a*, the cross member 206 can be an outer tenon tongue 214 shaped and sized to fit into the horizontally-oriented opening 204. When the outer tenon tongue 214 is positioned inside the horizontally-oriented opening 204, the vertical opening 208 in the base member can provide stability for the vertical post 210 at the angle 209.

Figure 2B:
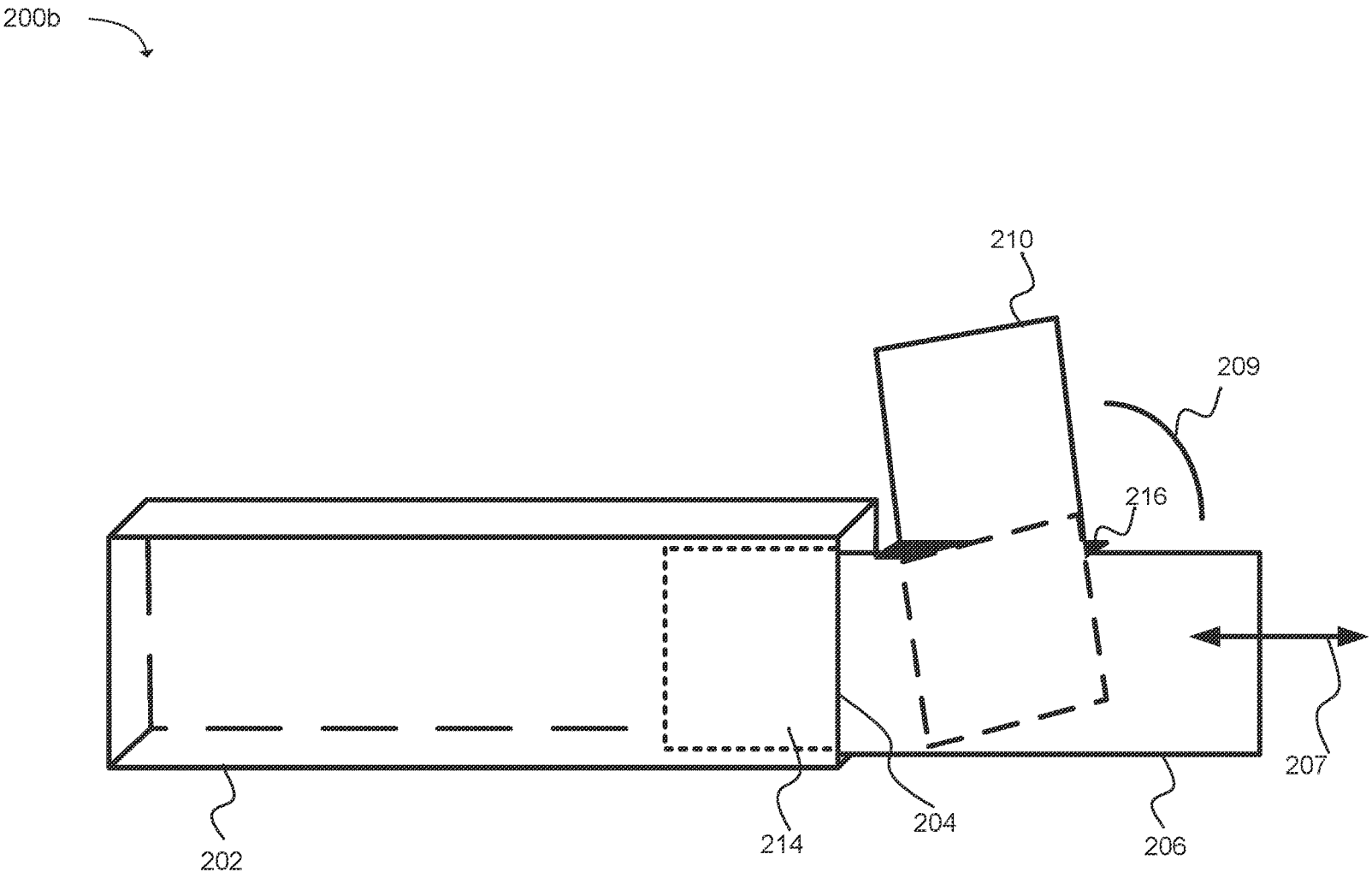
FIG. 2*b* shows a cross-sectional view of a portable frame for a sports net holding a vertical post at an angle other than 90° in accordance with an example embodiment.

When the cross member opening 216 is shaped and sized to receive and hold the vertical post 210 at the angle 209, as illustrated in FIG. 2*b*, the portable frame for a sports net 200*b* can comprise the cross member 206 which can be an outer tenon tongue 214 shaped and sized to fit into the horizontally-oriented opening 204. When the outer tenon tongue 214 is positioned inside the horizontally-oriented opening 204, the cross member opening 216 can provide stability for the vertical post 210 at the angle 209.

Figure 2C:
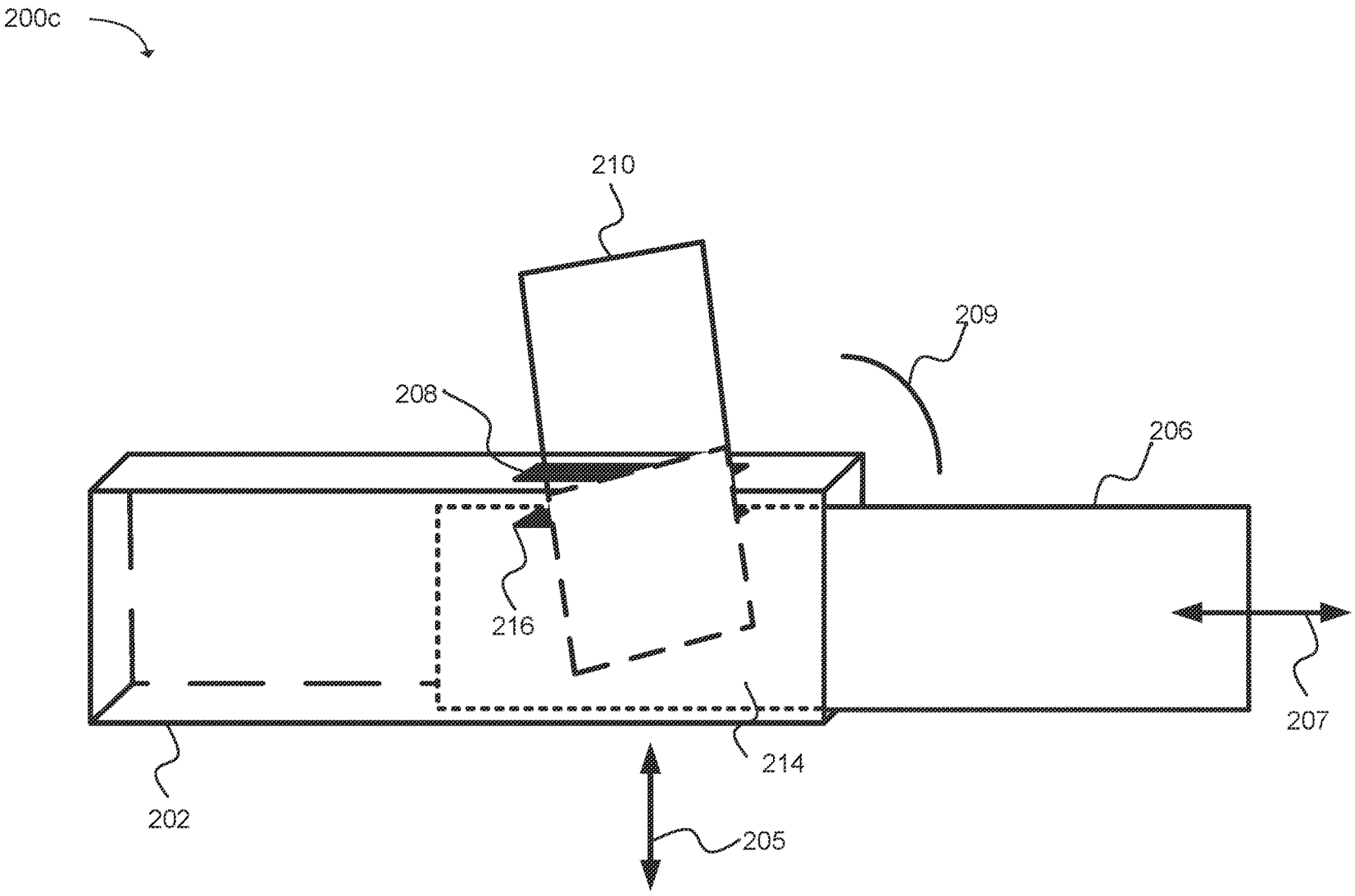
FIG. 2*c* shows a cross-sectional view of a portable frame for a sports net holding a vertical post at an angle other than 90° in accordance with an example embodiment.

When both the vertical opening 208 and the cross member opening 216 are shaped and sized to receive and hold the vertical post 210 at the angle 209, as illustrated in FIG. 2*c*, the portable frame for a sports net 200*c* can comprise the cross member opening 216 which can be an outer tenon tongue socket 216 in an outer tenon tongue 214. In this case, the outer tenon tongue socket 216 can be shaped and sized to receive and hold the vertical post 210 at the angle 209, and the vertical opening 208 can also be shaped and sized to receive and hold the vertical post 210 at the angle 209.

When both the vertical opening 208 and the cross member opening 216 are shaped and sized to receive and hold the vertical post 210 at the angle 209, the outer tenon tongue 214 can be shaped and sized to fit into the horizontally-oriented opening 204. When the outer tenon tongue 214 is positioned inside the horizontally-oriented opening 204, the outer tenon tongue socket 216 from the outer tenon tongue 214 can align with the vertical opening 208 in the base member. The alignment between the outer tenon tongue socket 216 and the vertical opening 208 can provide combined stability to the vertical post 210 at the angle 209.

In another example, when the outer tenon tongue 214 is positioned inside the horizontally-oriented opening 204, the vertical opening 208 can be shaped and sized to receive and hold the vertical post 210 at the angle 209, but the cross member opening 216 may be shaped and sized to receive the vertical post 210 at the angle 209 without being shaped and sized to hold the vertical post 210 at the angle 209. For example, the vertical opening 208 can hold the vertical post 210 at the angle 209 and therefore provide the stability to maintain the vertical post 210 at the angle 209 without additional stability from the cross member opening 216.

In another example, when the outer tenon tongue 214 is positioned inside the horizontally-oriented opening 204, the cross member opening 216 can be shaped and sized to receive and hold the vertical post 210 at the angle 209, but the vertical opening 208 may be shaped and sized to receive the vertical post 210 at the angle 209 without being shaped and sized to hold the vertical post 210 at the angle 209. For example, the cross member opening 216 can hold the vertical post 210 at the angle 209 and therefore provide the stability to maintain the vertical post 210 at the angle 209 without additional stability from the vertical opening 208.

When the outer tenon tongue 214 is positioned inside the horizontally-oriented opening 204, the outer tenon tongue socket 216 from the outer tenon tongue 214 can align with the vertical opening 208 in the base member. In this situation, the vertical post 210 can be operable to secure the cross member 206 to the base member 202 when a bottom end of the vertical post 210 is joined to the vertical opening 208 in the base member.

In one example, the vertical opening 208 can be operable to receive the vertical post 210 held at an angle other than 90 degrees relative to the horizontal plane 207 of the cross member 206 when the vertical post 210 and the cross member 206 are in the same vertical plane 205. The vertical post 210 can be shaped and sized to fit into the vertical opening 208.

In one example, the angle 209 other than 90° can be about 91°. In one example, the angle 209 other than 90° can be an angle greater than 90° and less than 95°. In another example, the angle 209 other than 90° can be an angle greater than 90° and less than 100°. In another example, the angle 209 other than 90° can be an angle greater than 90° and less than 105°. In another example, the angle 209 other than 90° can be an angle greater than 90° and less than 110°. In another example, the angle 209 other than 90° can be an angle greater than 90° and less than 120°.

In another example, the angle 209 other than 90° can be any suitable angle greater than 90° that can be configured to retain a top edge of a sports net in a taut orientation relative to a slack orientation of the top edge of the sports net when an angle relative to the horizontal plane of the cross member is 90°. For example, when the angle relative to the horizontal plane is 90°, then the top edge of the sports net can have a slack orientation comprising a relative tensile force of 0 N or a relative displacement of about 0 inches. When the angle relative to the horizontal plane is 91°, then the top edge of a sports net having vertical dimensions of 36 inches and horizontal dimensions of about 21 feet 9 inches can have a taut orientation comprising a relative tensile force of greater than ON (e.g. from 0.1 N to 500 N) and a relative displacement of about 0.6284 inches for each vertical post 210 for a total relative displacement of about 1.257 inches between two vertical posts positioned about 21 feet and 9 inches apart.

The angle 209 other than 90° can be configured to retain the top edge of the sports net in a taut orientation using an extension spring effect. For example, the net can have an amount of displacement when pulled from a slack orientation that is proportional to the amount of force exerted to pull the net from the slack orientation. In one example, the amount of displacement, x, can be approximately equal to the amount of force exerted to pull the net from the slack orientation, F, divided by a positive real number, k, which can be a property of the net (e.g., the stiffness of the net).

The angle 209 can provided enhanced tautness even when components of the straps have worn out. For example, a strap that is held by Velcro® can wear out over time, which can reduce the tautness of the net. By also including the angle 209, the tautness of the net can be enhanced even after the wear and tear arising from weakened Velcro®.

When the angle 209 is about 91°, then the offset arising from the increased angle can adequately tension the net top without excessively changing the dimensions of the net. When the angle is higher than 91° (e.g., or 92°, or 93°, or 94°, or 95°), then the changed dimensions at the net top can be noticeable, which can interfere with the gameplay for users who may be accustomed to precise dimensions in a racquet-based sport, such as pickleball, tennis, badminton, or the like.

The outer tenon tongue 214 can comprise various materials including one or more of: solid plastic or metal or a hollow mold thereof, the like, or a combination thereof. The base member 202, the cross member 206, the vertical post 210, or a combination thereof can comprise one or more of: wood, aluminum, steel, alloys thereof, plastics, such as vinyl, acrylic, compounds thereof, the like, or a combination thereof.

Figure 2D:
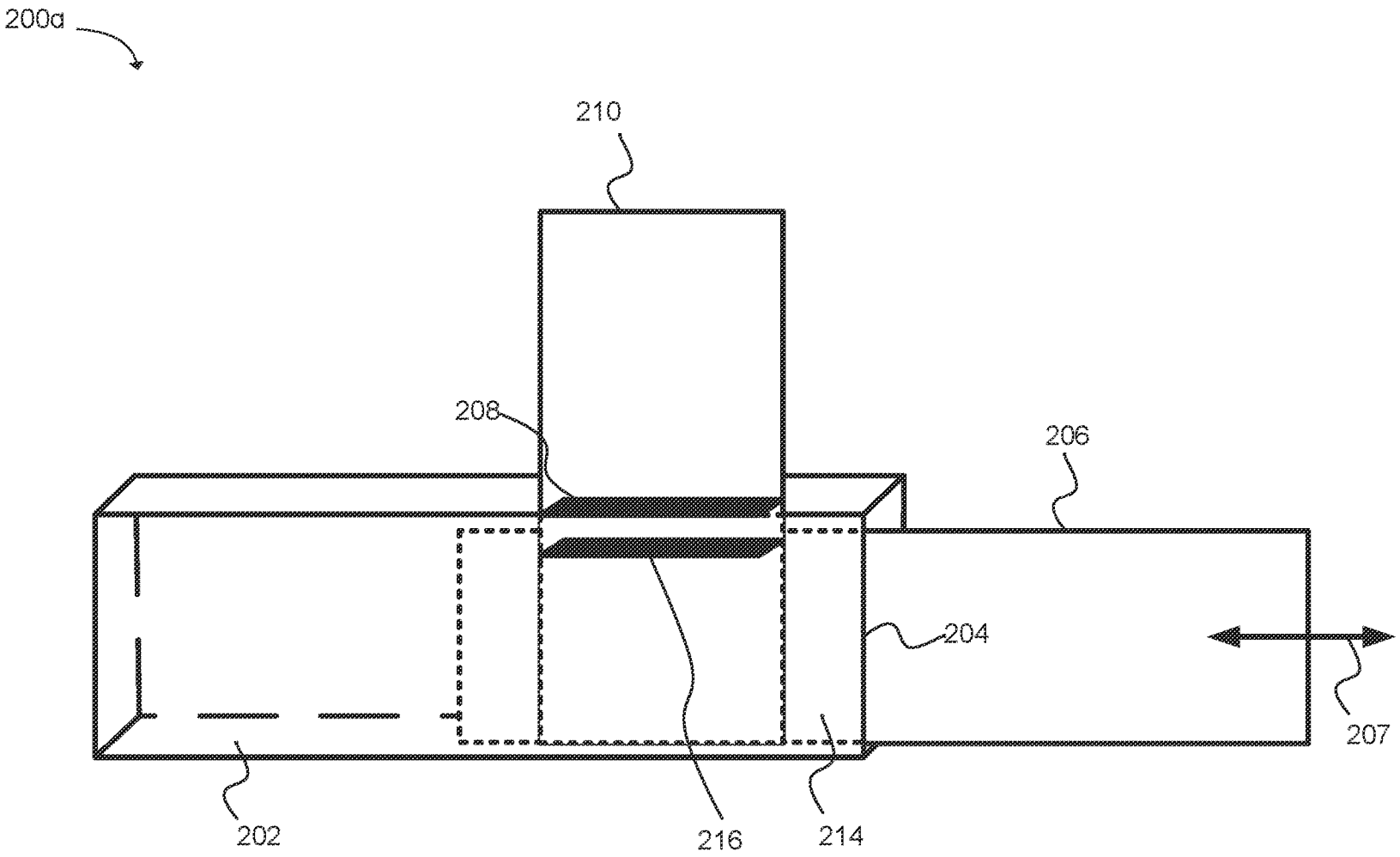
FIG. 2*d* shows a cross-sectional view of a portable frame for a sports net holding a vertical post in accordance with an example embodiment.

In one embodiment, as illustrated in FIG. 2*d*, the portable frame for a sports net 200*d* can comprise the base member 202 which can comprise a vertical opening 208 that can be operable to receive a vertical post 210. The vertical post 210 can be held at an angle that can be about 90° relative to a horizontal plane 207 of the cross member 206. The cross member opening 216 can be an outer tenon tongue socket 216 in an outer tenon tongue 214. In this case, the outer tenon tongue socket 216 can be shaped and sized to receive the vertical post 210, or hold the vertical post 210, or a combination thereof, and the vertical opening 208 can also be shaped and sized to receive the vertical post 210, hold the vertical post 210, or a combination thereof.

In one example, when the outer tenon tongue 214 is positioned inside the horizontally-oriented opening 204, the outer tenon tongue socket 216 from the outer tenon tongue 214 can align with the vertical opening 208 in the base member. In this situation, the vertical post 210 can be operable to secure the cross member 206 to the base member 202 when a bottom end of the vertical post 210 is joined to the vertical opening 208 in the base member.

Figure 3A:
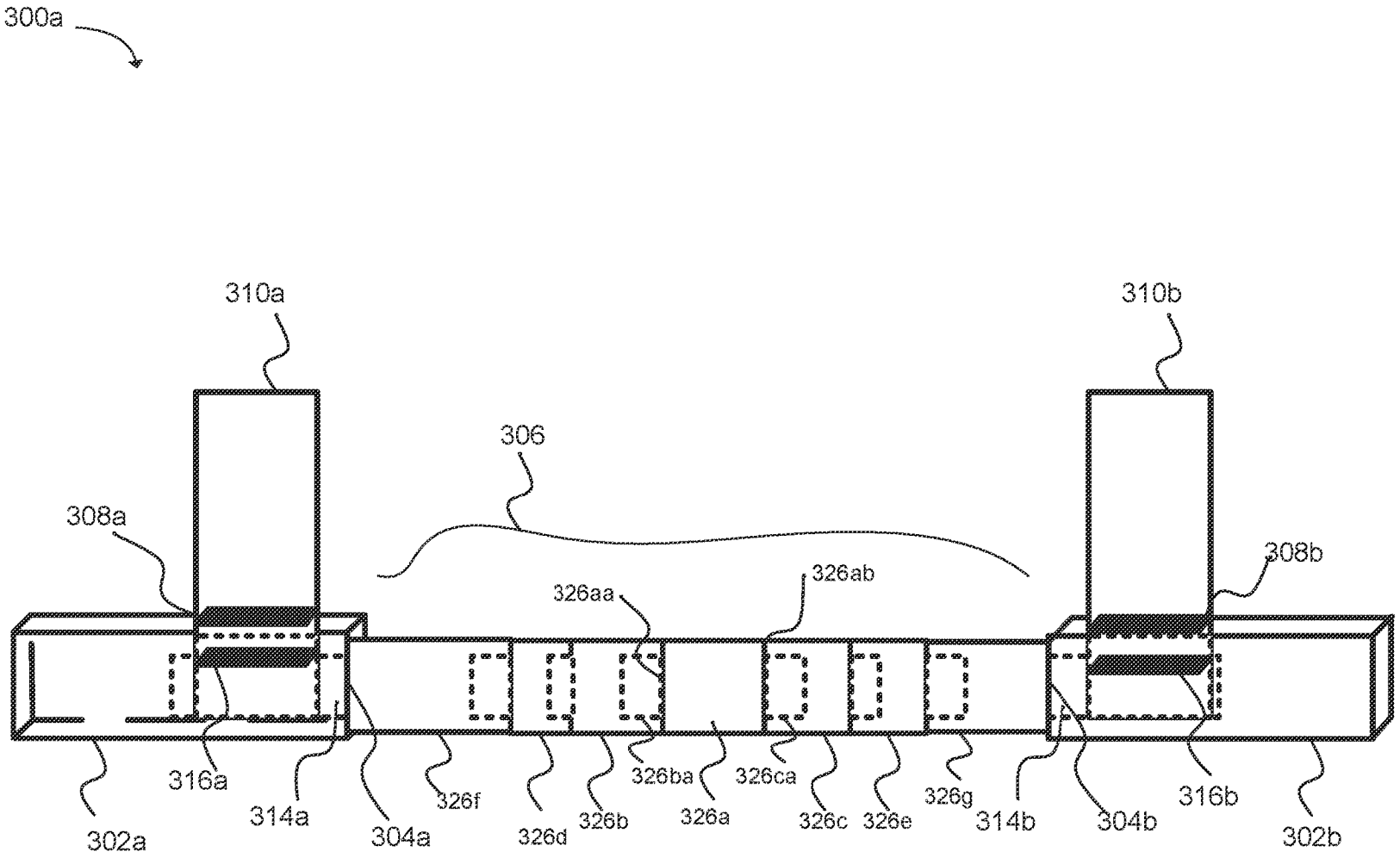
FIG. 3*a* shows a cross-sectional view of a portable frame for a sports net holding a vertical post in accordance with an example embodiment.

In one embodiment, as illustrated in FIG. 3*a*, a portable frame for a sports net can comprise a frame 300*a* including first and second base members 302*a* and 302*b* with first and second horizontally-oriented openings 304*a* and 304*b* operable to receive a cross member 306 connecting the first and second base members 302*a* and 302*b*. The first and second base members 302*a* and 302*b* can further include first and second vertical openings 308*a* and 308*b*. The cross member 306 can include first and second outer tenon tongues 314*a* and 314*b* shaped and sized to fit into the first and second horizontally-oriented openings 304*a* and 304*b*. The first and second outer tenon tongues 314*a* and 314*b* can include first and second outer tenon tongue sockets 316*a* and 316*b*.

The portable frame can further include first and second vertical posts 310*a* and 310*b* shaped and sized to fit into the first and second vertically-oriented openings 308*a* and 308*b*. The first and second base members 302*a* and 302*b* can be configured in the same vertical plane as the cross member 306.

In one example, the cross member 306 can comprise one or more segmented cross members 326*a* to 326*g*. The segmented cross members 326*a* to 326*g* can include a middle segment 326*a* having a first end 326*aa* with a first horizontally-oriented tenon tongue and a second end 326*ab* with a second horizontally-oriented tenon tongue. In one aspect, the cross member can further comprise a first inner segment 326*b* having a first inner mortice 326*ba* shaped and sized to join the first end 326*aa* of the middle segment 326*a*, and a second inner segment 326*c* having a second inner mortice 326*ca* shaped and sized to join the second end 326*ab* of the middle segment 326*a*.

The first and second vertical posts 310*a* and 310*b* can be operable to secure the cross member 306 to the first and second base members 302*a* and 302*b* when a bottom end of the first and second vertical posts 310*a* and 310*b* is joined to the first and second vertical openings 308*a* and 308*b* and the first and second outer tenon tongue sockets 316*a* and 316*b*.

Figure 3B:
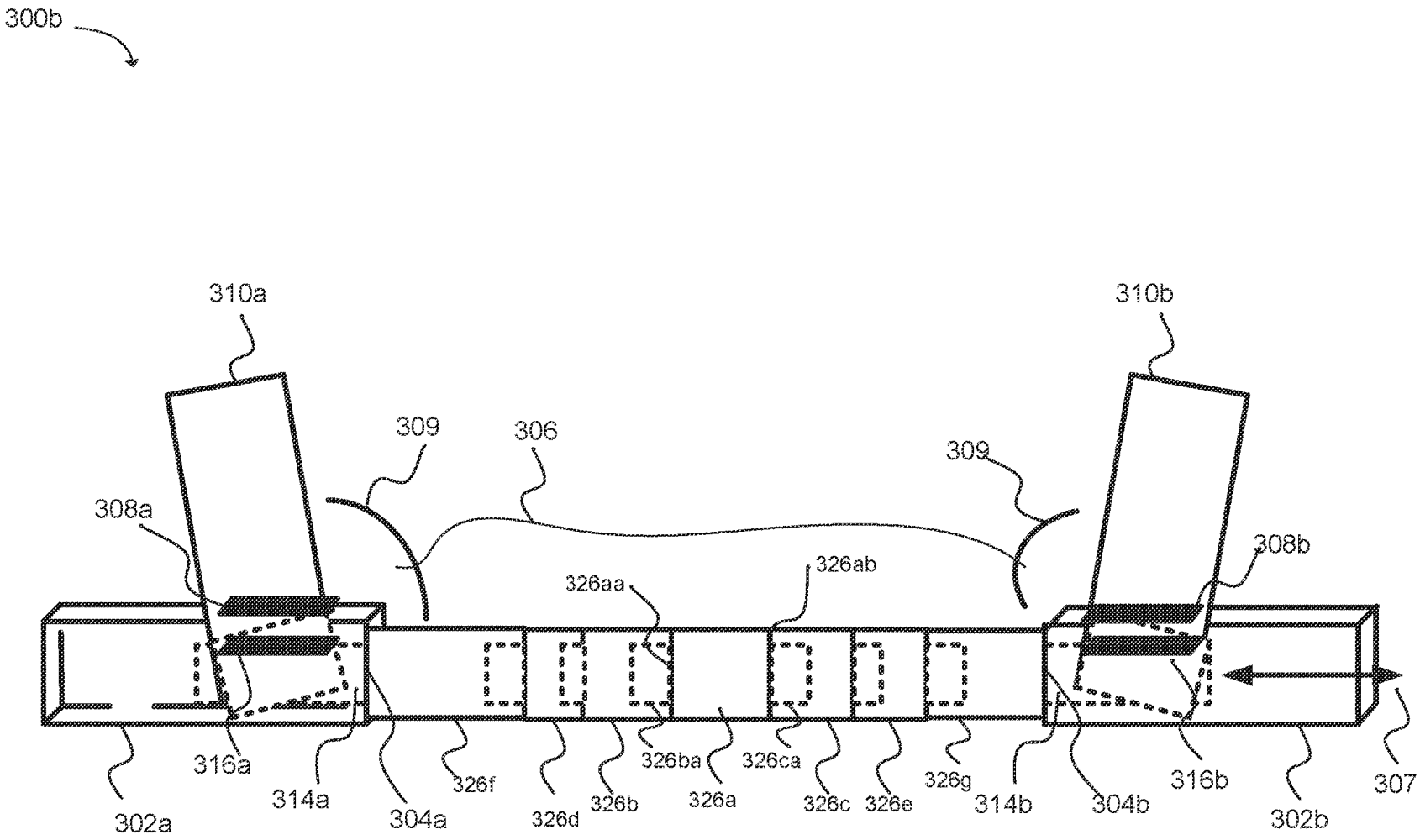
FIG. 3*b* shows a cross-sectional view of a portable frame for a sports net holding a vertical post at an angle other than 90° in accordance with an example embodiment.

In one embodiment, as illustrated in FIG. 3*b*, a portable frame for a sports net can comprise a frame 300*b* including first and second base members 302*a* and 302*b* with first and second horizontally-oriented openings 304*a* and 304*b* and first and second vertical openings 308*a* and 308*b*. The frame 300*b* can be operable to receive first and second verticals posts 310*a* and 310*b* held at an angle 309 other than 90° relative to a horizontal plane 307 of the cross member 306.

The cross member 306 can include first and second outer tenon tongues 314*a* and 314*b* shaped and sized to fit into the first and second horizontally-oriented openings 304*a* and 304*b*. The first and second outer tenon tongues 314*a* and 314*b* can include first and second outer tenon tongue sockets 316*a* and 316*b*.

In one example, the cross member 306 can comprise one or more segmented cross members 326*a* to 326*g*. The segmented cross members 326*a* to 326*g* can include a middle segment 326*a* having a first end 326*aa* with a first horizontally-oriented tenon tongue and a second end 326*ab* with a second horizontally-oriented tenon tongue. In one aspect, the cross member can further comprise a first inner segment 326*b* having a first inner mortice 326*ba* shaped and sized to join the first end 326*aa* of the middle segment 326*a*, and a second inner segment 326*c* having a second inner mortice 326*ca* shaped and sized to join the second end 326*ab* of the middle segment 326*a*.

The cross member can further comprise additional segmented cross members 326*d*, 326*e* configured to join other segmented cross members between the middle segment 326*a* and first and second outer segments 326*f* and 326*g*. In one example, the additional segmented cross member 326*d* can be configured to join: (a) the first outer segment 326*f* and (b) the middle segment 326*a* or an intervening segment (e.g., 326*b*) joined to the middle segment 326*a*. In one example, the additional segmented cross member 326*e* can be configured to join: (a) the second outer segment 326*g* and (b) the middle segment 326*a* or an intervening segment (e.g., 326*c*) joined to the middle segment 326*a*.

The additional segmented cross member 326*d* can be configured to join a mortice of the first outer segment 326*f* using a horizontally-oriented tenon tongue, and can be configured to join a tenon of the middle segment 326*a* (or an intervening segment such as 326*b*) using a mortice. The additional segmented cross member 326*e* can be configured to join a mortice of the second outer segment 326*g* using a horizontally-oriented tenon tongue, and can be configured to join a tenon of the middle segment 326*a* (or an intervening segment such as 326*c*) using a mortice.

In another aspect, the horizontally-oriented tenon tongue, the mortice, or a combination thereof can be formed using injection molding. In another example, the horizontally-oriented tenon tongue, the mortice, or a combination thereof can be formed using plastic extrusion. In one example, the plastic resin can be pushed through a die to shape and size the horizontally-oriented tenon tongue, the mortice, or a combination thereof. When formed using plastic extrusion, the horizontally-oriented tenon tongue, the mortice, or a combination thereof can comprise an enhanced uniformity of surface when compared the horizontally-oriented tenon tongue or the mortice formed using injection molding. The enhanced uniformity of surface can enhance the tightness of the fit between the horizontally-oriented tenon tongue and the mortice. In another aspect, the enhanced uniformity of the surface can ease the insertion of the horizontally-oriented tenon tongue into the mortice.

In another aspect, the horizontally-oriented tenon tongue, the mortice, or a combination thereof can be coupled within each of the segmented cross members 326*a* to 326*g* using one or more screws that can constrain the movement of the horizontally-oriented tenon tongue, the mortice, or a combination thereof within the segmented cross members 326*a* to 326*g*. In one example, each of the segmented cross members 326*a* to 326*g* can be held in position using 2 screws. In another example, each of the segmented cross members 326*a* to 326*g* can be held in position using 4 screws. In another aspect, the screws can be coupled using spacers (e.g., countersunk spacers).

In one aspect, the horizontally oriented tenon tongue, the mortice, or a combination thereof can be coupled within each of the segmented cross members 326*a* to 326*g* to a length of from 100 mm to about 300 mm. In one aspect, the horizontally oriented tenon tongue, the mortice, or a combination thereof can be coupled within each of the segmented cross members 326*a* to 326*g* to a length of from 150 mm to about 250 mm, the horizontally oriented tenon tongue, the mortice, or a combination thereof can be coupled within each of the segmented cross members 326*a* to 326*g* to a length of about 200 mm.

Figure 4:
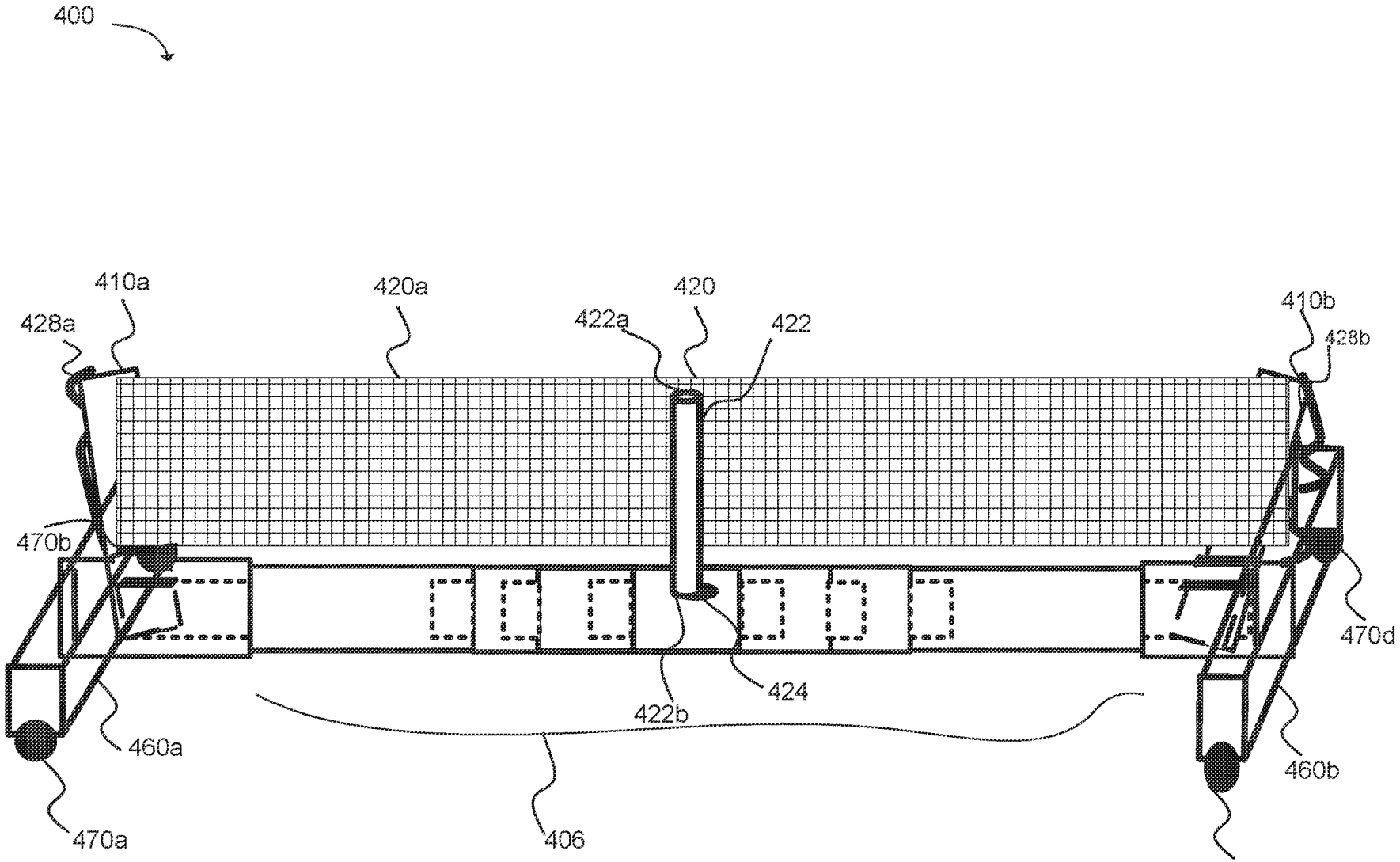
FIG. 4 shows a perspective view of a portable sports net assembly in accordance with an example embodiment.

In another embodiment, as illustrated in FIG. 4, a portable frame for a sports net 400 can include first and second vertical posts 410*a* and 410*b* that can each include straps 428*a* and 428*b* operable to secure a top edge of the sports net 420 in a taut orientation relative to a slack orientation of the top edge of the sports net 420 when straps 428*a* and 428*b* do not secure the top edge of the sports net 420. In one aspect, the taut orientation of the top edge of the sports net 420 can be enhanced when the vertical posts 410*a* and 410*b* are held at an angle other than 90° relative to a taut orientation of the top edge of the sports net when the straps 428*a* and 428*b* secure the top edge of the sports net 420.

In one aspect, the straps can comprise a natural or synthetic fabric made from any suitable substance, such as nylon, rayon, polyesters, cotton, hemp, linen, the like, or a combination thereof. In another aspect, the straps can further comprise a hook and loop fastener (e.g. Velcro®) and the like.

In one aspect, the portable frame can include a flexible support 422 having a fiberglass material with a bottom end 422*a* fitting a recess 424 in the cross member 406 and a top elongated split end 422*b* fitting an underside of the top 420*a* of a sports net 420. In one aspect, the first and second vertical posts 410*a* and 410*b* can be configured to retain the sports net 420 above the cross member 406.

In another aspect, the first and second base members 402*a* and 402*b* can further comprise first and second elongated bars 460*a* and 460*b* that can include casters 470*a*, 470*b*, 470*c*, and 470*d*. In another aspect, the cross member 406 can include casters.

Figure 5:
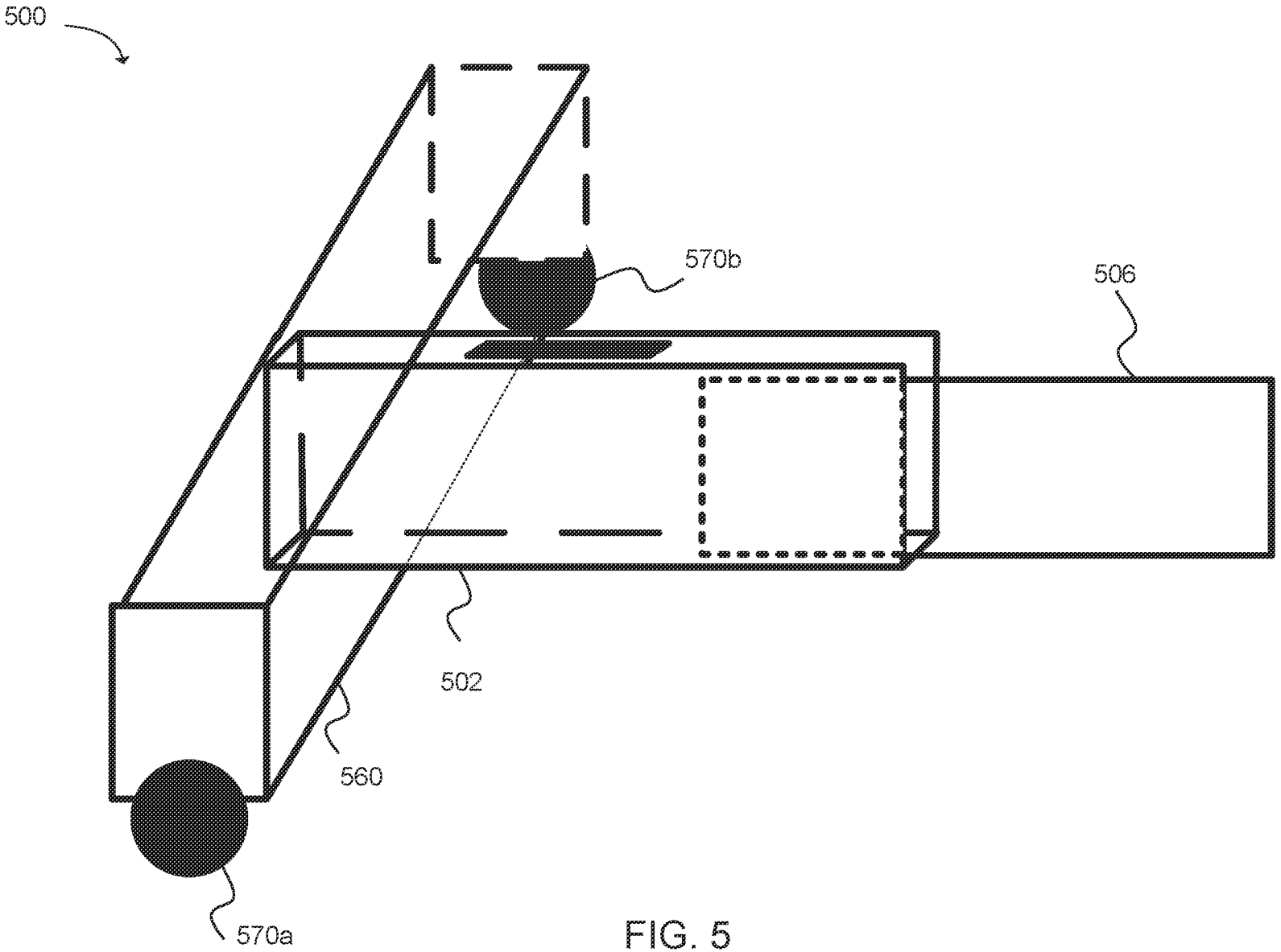
FIG. 5 shows a perspective view of a portable frame for a sports net in accordance with an example embodiment.

In another embodiment, as illustrated in FIG. 5, a portable frame for a sports net 500 can comprise the base member 502 which can comprise an elongated bar 560 that can include one or more casters 570*a* or 570*b*. The elongated bar 560 can be oriented in the same horizontal plane as the base member 502 but in a vertical plane that is orthogonal to the vertical plane of the cross member 506. In one aspect, the elongated bar 560 can be integrally formed with the base member 502. In another aspect, the elongated bar 560 can be separately formed from the base member 502.

Figure 6:
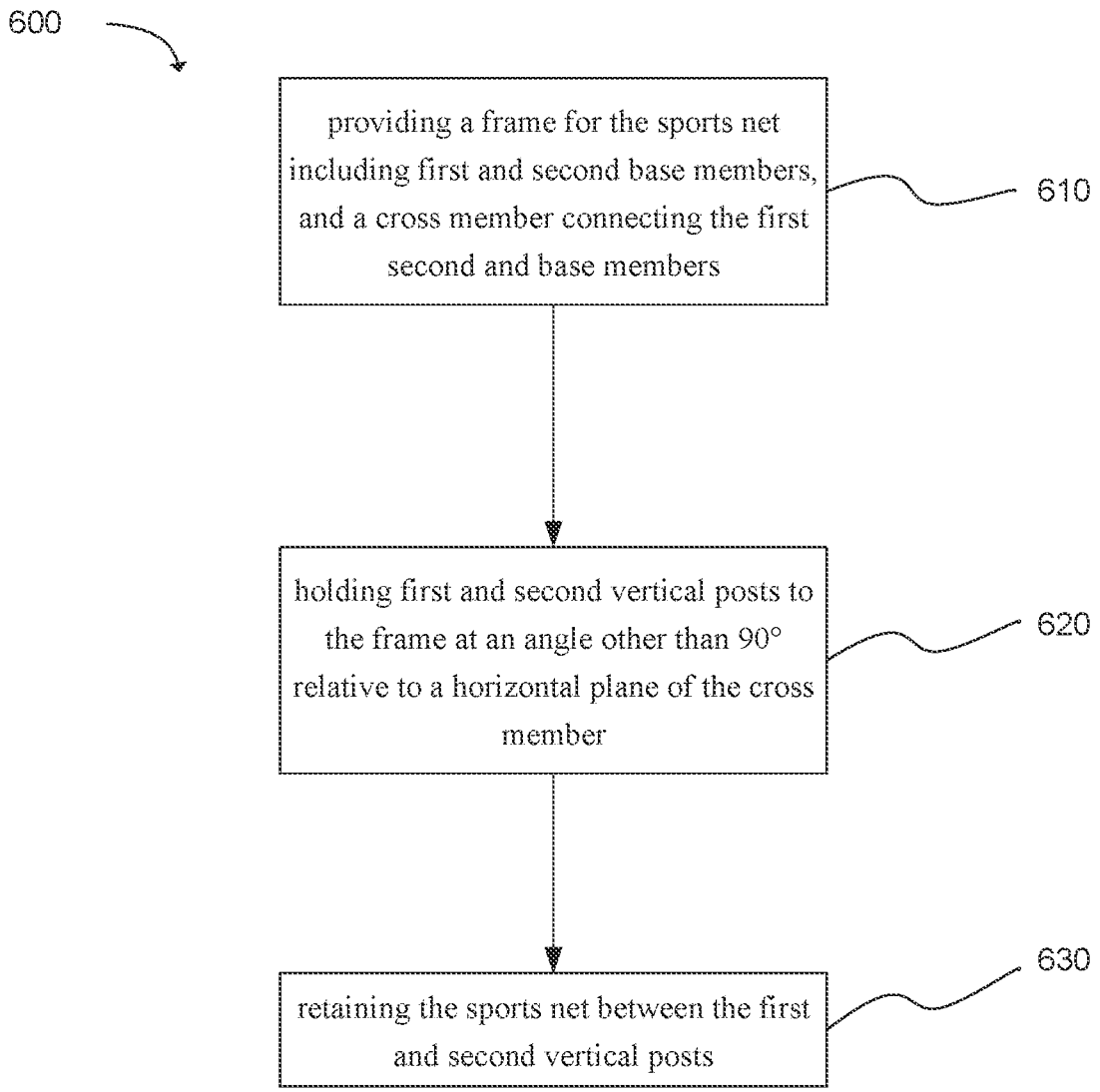
FIG. 6 depicts functionality for tensioning a sports net in accordance with an example embodiment.

A method of tensioning a sports net is also described herein. FIG. 6 depicts aspects of a method 600 for tensioning a sports net, as described in the flowchart. The method can comprise providing a frame for the sports net including first and second base members, and a cross member connecting the first second and base members, as in block 610. The method can comprise holding first and second vertical posts to the frame at an angle other than 90° relative to a horizontal plane of the cross member, as in block 620. The method can comprise retaining the sports net between the first and second vertical posts, as in block 630.

In one aspect, the method can comprise holding the first and second vertical posts to the frame at the angle other than 90° using first and second vertical openings in the first and second base members. In another aspect, the method can comprise holding the first and second vertical posts to the frame at the angle other than 90° using first and second cross members openings. In another aspect, the first and second cross member openings can be first and second outer tenon tongue sockets in the cross member. In another aspect, the method can comprise retaining a top edge of a sports net in a taut orientation relative to a slack orientation of the top edge of the sports net when an angle relative to the horizontal plane of the cross member is 90°. In another aspect, the method can comprise retaining a top edge of a sports net in a taut orientation using an extension spring effect. In yet another aspect, the angle other than 90° can be 91°.

It is noted that no specific order is required in these methods unless used by the claims set forth herein, though generally in some embodiments, the method operations can be carried out sequentially.

Of course, it is to be understood that the above-described arrangements are illustrative of the application of the principles of the present disclosure. Numerous modifications and alternative arrangements may be devised by those skilled in the art without departing from the spirit and scope of the present disclosure and the appended claims are intended to cover such modifications and arrangements. Thus, while the present disclosure has been described above with particularity and detail in connection with what is presently deemed to be the most practical embodiments of the disclosure, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A portable frame for a sports net, comprising:

first and second base members with first and second horizontally-oriented openings in the first and second base members, respectively, operable to receive a cross member connecting the first and second base members, and first and second vertical openings in the first and second base members, respectively, operable to receive first and second vertical posts held at an angle other than 90° relative to a horizontal plane of the cross member;

a cross member comprising first and second outer tenon tongues at ends of the cross member, wherein the first and second outer tenon tongues respectively comprise first and second cross member openings shaped and sized to receive and hold the first and second vertical posts at the angle other than 90°; and first and second vertical posts operable to fit into the first and second vertical openings of the first and second base members and the first and second cross member openings of the cross member when the outer tenon tongues of the cross member are inserted into the first and second horizontally-oriented openings of the first and second base members, wherein the first and second vertical openings and the first and second cross member openings are positioned to hold the first and second vertical posts at the angle other than 90°.

2. The portable frame of claim 1, wherein the first and second outer tenon tongues comprise a solid plastic material, a solid metal material, a hollow plastic material, a hollow metal material, or a combination thereof.

3. The portable frame of claim 1, wherein the first and second vertical posts are operable to secure the cross member to the first and second base members when a bottom end of the first and second vertical post are joined to the first and second vertical openings inside of the first and second base members.

4. The portable frame of claim 1, wherein the first and second vertical openings are operable to receive the first and second vertical posts held at an angle other than 90 degrees relative to the horizontal plane of the cross member when the first and second vertical posts and the cross member are in the same vertical plane.

5. The portable frame of claim 1, wherein the angle other than 90° is a 91° angle.

6. The portable frame of claim 1, wherein the first and second vertical posts held at the angle other than 90° are configured to retain a top edge of a sports net in a taut orientation relative to a slack orientation of the top edge of the sports net when an angle of the first and second vertical posts relative to the horizontal plane of the cross member is 90°.

7. The portable frame of claim 1, wherein the first and second vertical posts held at the angle other than 90° are configured to retain a top edge of a sports net in a taut orientation using an extension spring effect.

8. The portable frame of claim 1, wherein the cross member further comprises segmented cross members including a middle segment having a first end with a first horizontally-oriented tenon tongue and a second end with a second horizontally-oriented tenon tongue.

9. The portable frame of claim 8, wherein the segmented cross members further comprise:

a first inner segment having a first inner mortice shaped and sized to join the first end of the middle segment; and a second inner segment having a second inner mortice shaped and sized to join the second end of the middle segment.

10. The portable frame of claim 1, wherein the first and second vertical posts each include straps operable to secure a top edge of a sports net in a taut orientation.

11. The portable frame of claim 1, further comprising a flexible support having a fiberglass material with a bottom end fitting a recess in the cross member and a top elongated split end fitting an underside of a sports net top.

12. The portable frame of claim 1, wherein the first and second vertical posts are configured to retain a sports net above the cross member.

13. A portable frame for a sports net, comprising:

first and second base members with first and second horizontally-oriented openings in the first and second base members, respectively, operable to receive a cross member connecting the first and second base member, and first and second vertical openings in the first and second base members, respectively, operable to receive first and second vertical posts;

a cross member including first and second outer tenons tongues at ends of the cross member shaped and sized to fit into the first and second horizontally-oriented openings, wherein the first and second outer tenon tongues respectively include first and second cross member openings; and first and second vertical posts shaped and sized to fit into the first and second vertically-oriented openings and the first and second cross member openings, wherein the first and second base members and the cross member are configured in the same vertical plane;

wherein the cross member is of uniform exterior dimensions from the first base member to the second base member.

14. A portable sports net assembly, comprising:

a frame including first and second base members with first and second horizontally-oriented openings in the first and second base members, respectively, and first and second vertical openings in the first and second base members, respectively, operable to receive first and second vertical posts held at an angle other than 90° relative to a horizontal plane of the cross member;

a cross member comprising first and second outer tenon tongues shaped and sized to fit into the first and second horizontally-oriented openings, wherein the first and second outer tenon tongues respectively comprise first and second cross member openings;

first and second vertical posts shaped and sized to fit into the first and second vertical openings and the first and second cross member openings at an angle other than 90° relative to a horizontal plane of the cross member; and a net strung between the first and second vertical posts above the cross member, wherein the angle other than 90° retains a top edge of the net in a taut orientation using a spring effect;

wherein the cross member is rectangular in shape.

* * * * *